United States Patent [19]

Weihrauch

[11] 4,169,297

[45] Oct. 2, 1979

[54] CLEANING-IMPLEMENT HANDLE SECURING MEANS

[75] Inventor: Georg Weihrauch, Wald-Michelbach, Fed. Rep. of Germany

[73] Assignee: Coronet-Werke Heinrich Schlerf GmbH, Fed. Rep. of Germany

[21] Appl. No.: 769,969

[22] Filed: Feb. 18, 1977

[30] Foreign Application Priority Data

| | | | |
|---|---|---|---|
| Feb. 18, 1976 | [DE] | Fed. Rep. of Germany | 2606400 |
| May 19, 1976 | [DE] | Fed. Rep. of Germany | 2611683 |
| Nov. 10, 1976 | [DE] | Fed. Rep. of Germany | 2651259 |

[51] Int. Cl.[2] ..... A47L 13/11; B25G 3/28

[52] U.S. Cl. ..... 15/145; 15/245; 24/211 R; 24/211 P; 403/290; 403/374

[58] Field of Search ..... 15/145, 146, 147 B, 15/148, 154, 229 B, 229 BC, 229 BP, 229 BW, 144 R, 165, 212; 24/211 R, 211 P; 403/68, 157, 290, 374, DIG. 8, 350, 351; 292/19, 27, 49; 16/114 A

[56] References Cited

U.S. PATENT DOCUMENTS

| | | | |
|---|---|---|---|
| 703,046 | 6/1902 | Deaton | 24/211 X |
| 833,409 | 10/1906 | McGuire | 403/DIG. 8 |
| 964,817 | 7/1910 | Selleck | 403/374 |
| 1,219,398 | 3/1917 | Huntsman | 294/94 |
| 1,929,848 | 10/1933 | Neely | 15/147 B X |
| 2,084,589 | 6/1937 | Odgers | 30/171 |
| 2,658,222 | 11/1953 | Mackert | 15/145 X |
| 2,720,774 | 10/1955 | Gehrie | 292/27 X |
| 2,901,759 | 9/1959 | Smith et al. | 15/229 BP X |
| 3,808,633 | 5/1974 | Lauterbach | 403/350 |
| 3,953,138 | 4/1976 | Hine | 403/351 X |

FOREIGN PATENT DOCUMENTS

| | | | |
|---|---|---|---|
| 136457 | 12/1947 | Australia | 16/114 A |
| 289029 | 6/1953 | Switzerland | 15/145 |
| 310208 | 12/1955 | Switzerland | 15/145 |

*Primary Examiner*—Daniel Blum
*Attorney, Agent, or Firm*—Craig and Antonelli

[57] ABSTRACT

A handle having a sprung forked end is releasably securable to a cleaning-implement body by engagement of the fork arms in apertures in the body by means of a clamping device engaging between said arms and being movable, by rotation, displacement or pivoting, to spread the arms apart or draw them together. Various forms of clamping device (comprising a cam disc and/or a slider, or a pivoting lever), various configurations of fork arms and various features of said body are described.

21 Claims, 23 Drawing Figures

CLEANING-IMPLEMENT HANDLE SECURING MEANS

The invention relates to means for securing cleaning-implements, such as brooms, scrubbers, squeegees or the like to a handle, at the end of which there are two sprung branch arms forming a fork, which are securable in apertures of the body of the cleaning-implement by means of a device engaging between the branch arms of the fork.

In known practical forms of the construction (DT-PS No. 439,643) for brooms or scrubbing-implements, the branch arms extending parallel to each other are bent above the brush body, extended outwardly horizontally above the brush body, then again bent and introduced into the holes in the brush body. For clamping purposes two spring members are used, which are mounted to the horizontal portions of the branch arms of the respective springs having one limb inserted in an additional hole in the brush body and the other limb engaging behind the parallel portion of the respective branch arm.

By means of these spring members, whose limbs which engage behind the branch arms are, if necessary, interconnected in yoke fashion, the ends which engage the holes of the brush body are forced against the walls of the hole and thereby secured in position.

These known handle fixing devices are expensive and their external appearance is not particularly satisfactory. Moreover the securing of the handle involves several difficulties because the user must exert considerable force for the mounting and the disassembling of the handle.

In another known practical form (U.S. Pat. No. 1,692,110), the mounting operation is substantially simplified. In this case upon one of the branch arms there is hinged a sheet metal bridge, which at its other end carries a hook corresponding in shape to the cross section of the other branch arm. This bridge member is so pivoted that the hook partially engages over the other branch arm so that the bridge member then extends between both of the branch arms. By pressing into position the hook of the bridge member, the branch arms, the ends of which are outwardly bent, are brought into the spread apart condition and thus secured in the holes in the cleaning-implement.

Although this practical form of device is indeed easy to manipulate, it nevertheless has the disadvantage that it is quite easily released. The effect of a slight impact or the influence of torsional forces upon the two branch arms causes the bridge member to spring out. This type of securement is therefore quite unsuitable for the present practical purpose.

The present invention therefore takes as its basic purpose the construction of a device of the above-mentioned type in such a manner that it is easy to manipulate but, on the other hand, will offer a sufficient resistance to any pressure, tension and torsional forces arising from the use of the cleaning-implement.

Starting from the basis of a device of the construction first above mentioned, this problem is solved in accordance with the invention in that the device for securing the branch arms to the body of the cleaning implement is a clamping device carried upon both of said branch arms and having a manual control member and which, by rotation, displacement or pivoting between said branch arms, can be brought out of an open position into a closed position.

The adoption of the invention renders superfluous the use of the spring members of the type necessary in the known art, and thus eliminates the difficulties encountered in the fitting thereof. On the contrary, only one hand is necessary for manipulating the manual control member, and the amount of force necessary for that purpose can be maintained small by suitable design of the clamping device. Also eliminated are the additional bores in the body of the cleaning implement, which were previously necessary for holding the spring members. As contrasted with the other known construction all the conceivable forces, which could be exerted on the two branch arms to cause premature opening of the device, are absorbed because in the invention the clamping device is mounted upon both of the branch arms and these forces are transmitted into the support means.

In a preferred construction the clamping device includes a cam disc, which spreads apart the branch arms. This spreading action takes place in opposition to the spring force of the branch arms. The clamping device may be very easily operated; for example, upon the cam disc there is arranged a crossbar handle, which also indicates to the user the manner in which the cleaning implement is to be secured to its handle. Instead of spreading the branch arms, the clamping device may also be so designed that it draws together said branch arms. The selection of the one or the other construction depends upon the type of body for the cleaning implement.

Instead of the above described practical forms, it is possible for the clamping device to include a cam disc, which itself operates upon a sliding member displaceable between the branch arms. By means of the cam the slider is displaced, which then itself spreads apart or draws together the branch arms. The operation of this clamping device may in principle be the same as in the previously described practical form.

In order to avoid the necessity of providing any separate bearing arrangement for the cam disc, the branch arms themselves may be curved in the region of the cam disc to conform to the curvature thereof, so that the cam disc is guided between the branch arms by mounting the cam disc in the curved region thereof, from which it cannot be displaced.

According to another practical form it is possible for the clamping device to comprise only a slidable member which is displaceable in the direction of the branch arms and which draws together or spreads apart the branch arms. In accordance with this construction the sliding member may then be in the form of a sleeve engaging over the branch arms, or may be designed as a sliding member arranged between the branch arms.

In order to enhance the spring action, the branch arms may be bent over crosswise, in which case the clamping device then operates between the limbs of the branch arms situated above the crossing point, whilst the shanks of the branch arms situated below the crossing point engage in the holes in the body of the brush. In such a case if the cam disc mounted between the upper shanks of the branch arms exerts a spreading action thereon, a traction force is exerted to draw together the shanks of the branch arms situated below the crossing point.

A further structural simplification is effected and reliable functioning of the construction is ensured by providing the cam disc and/or the sliding member with peripheral slots, in which lie the branch arms. Secure support for the clamping device is then ensured in all its positions of movement.

According to a further variant of the invention the clamping device may comprise a pivoting lever, which is either a two-armed lever arranged at one side of both of the branch arms, or else is mounted between said branch arms. In the first case the pivoting lever is movable in the plane defined by the branch arms, and in the other case normal thereto.

Preferably those ends of the branch arms which are to engage in the holes in the body of the cleaning implement are upset, and when in the assembled position these ends engage in undercuts in the holes. This provides a positive securing of the branch arms equally whether these are releasable by or in opposition to the spring force thereof.

The invention will now be described with reference to several practical forms shown in the accompanying drawings, wherein.

Figure 16:
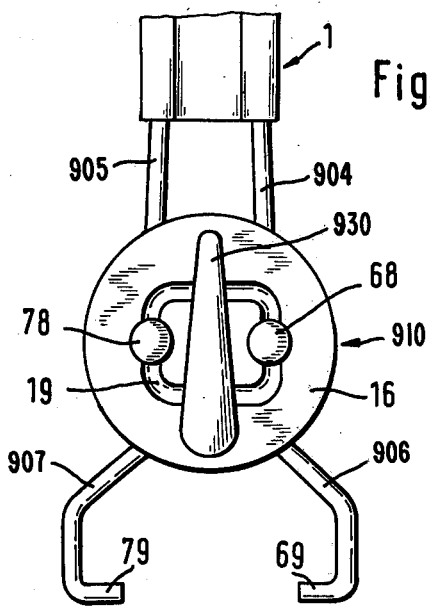
Figure 17:
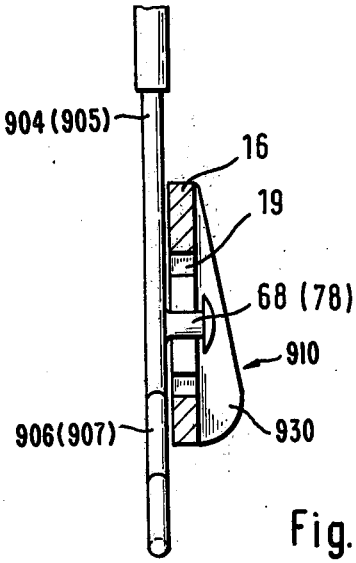
Figure 2:
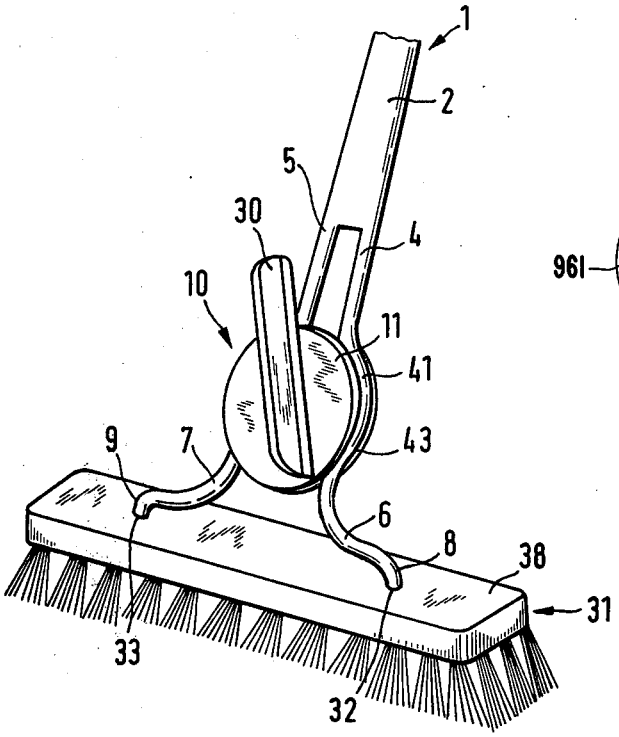
FIG. 2 shows the practical form according to FIG. 1 after being secured to a cleaning implement.
Figure 2A:
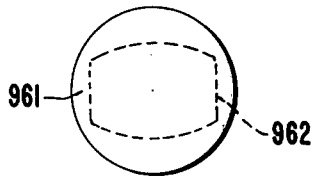
Figure 3:
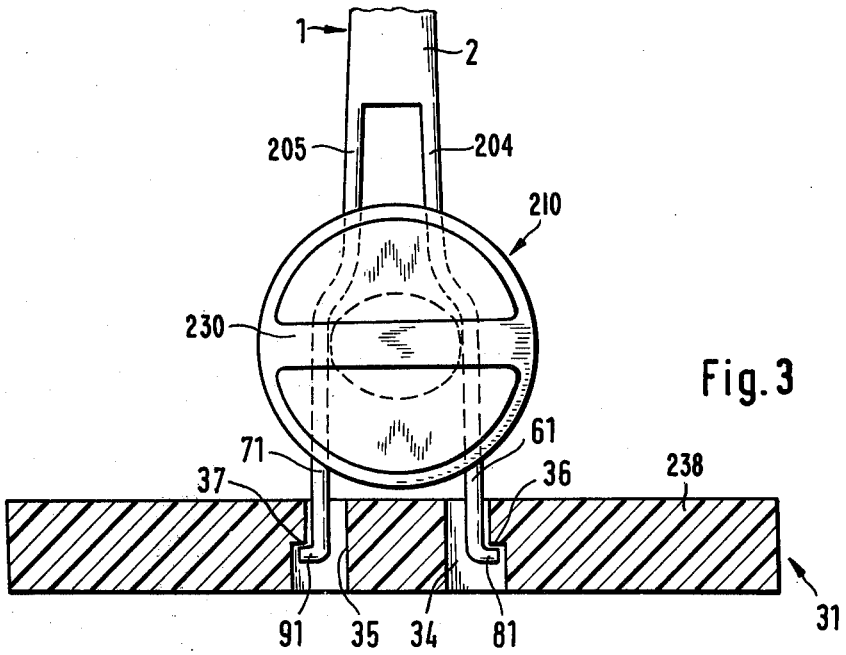
Figure 4:
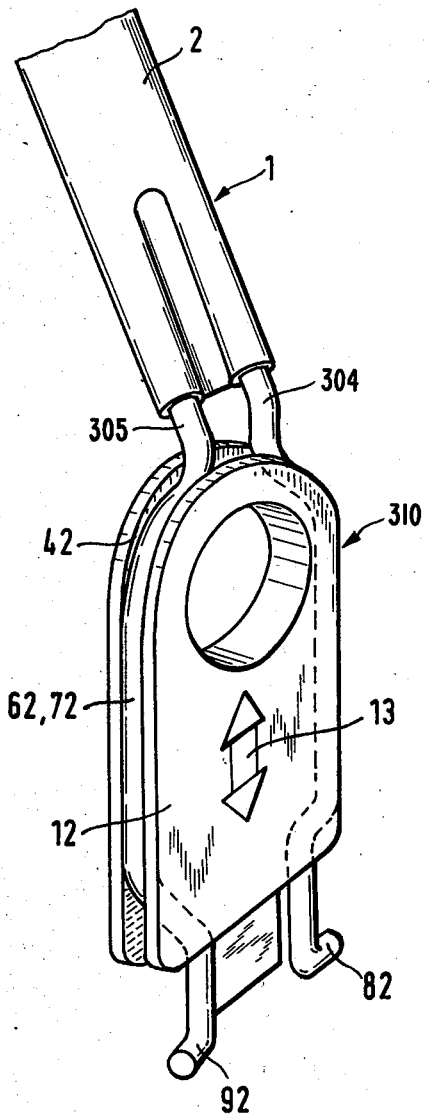
Figure 4A:
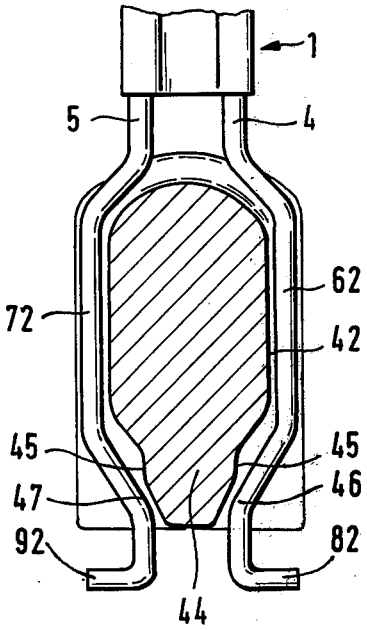
Figure 5:
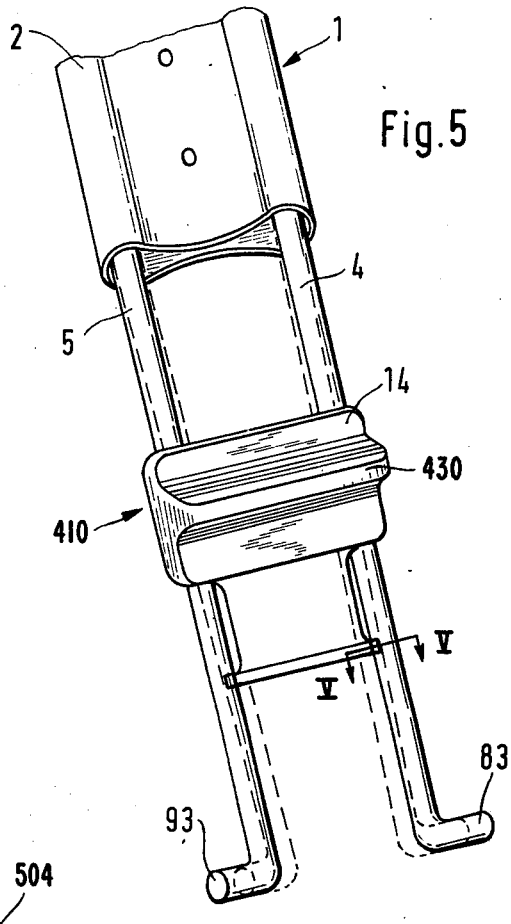
Figure 6:
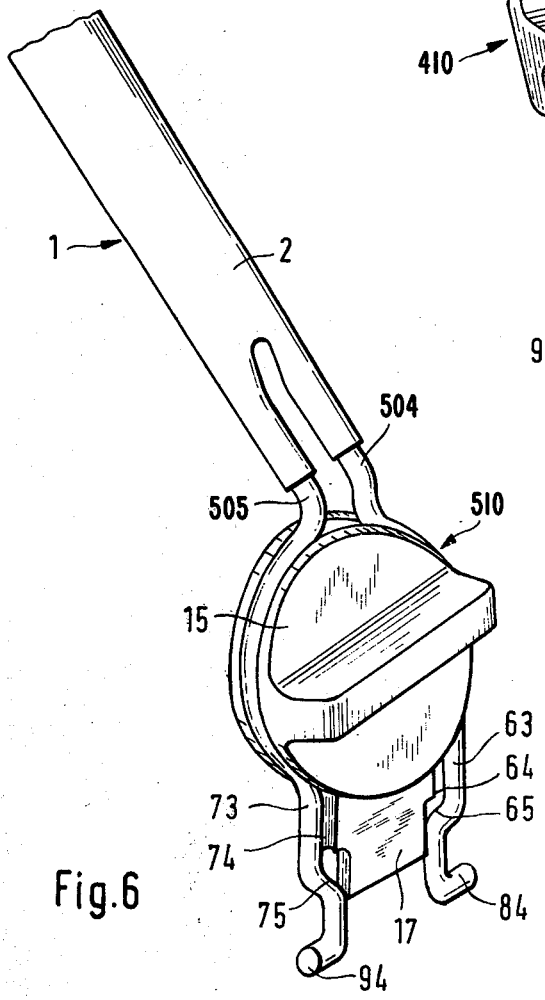
Figure 5A:
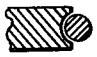
Figure 6A:
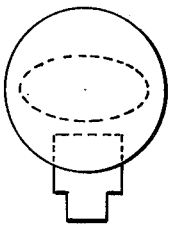
Figure 8:
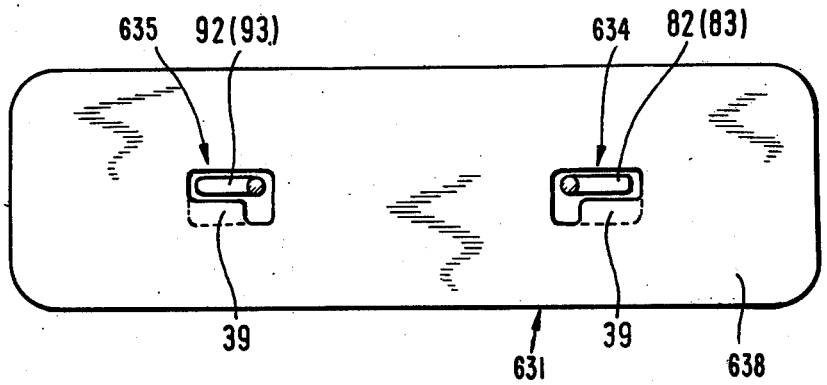
Figure 7:
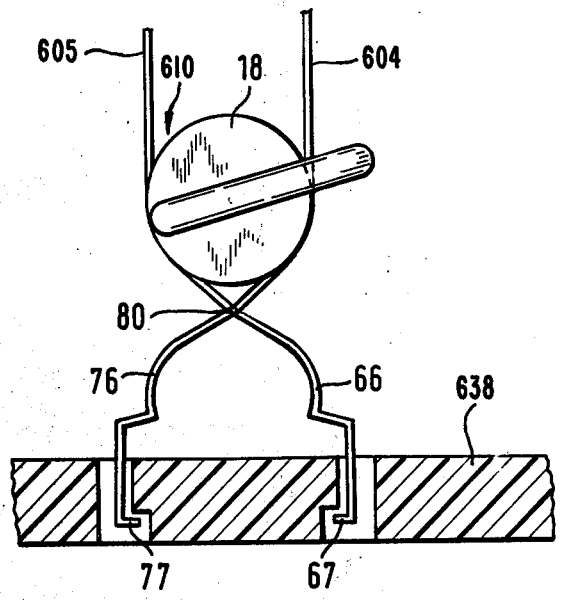
Figure 9:
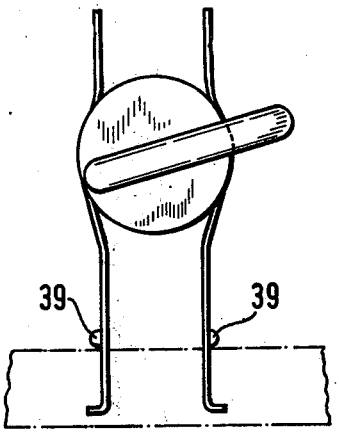
Figure 10:
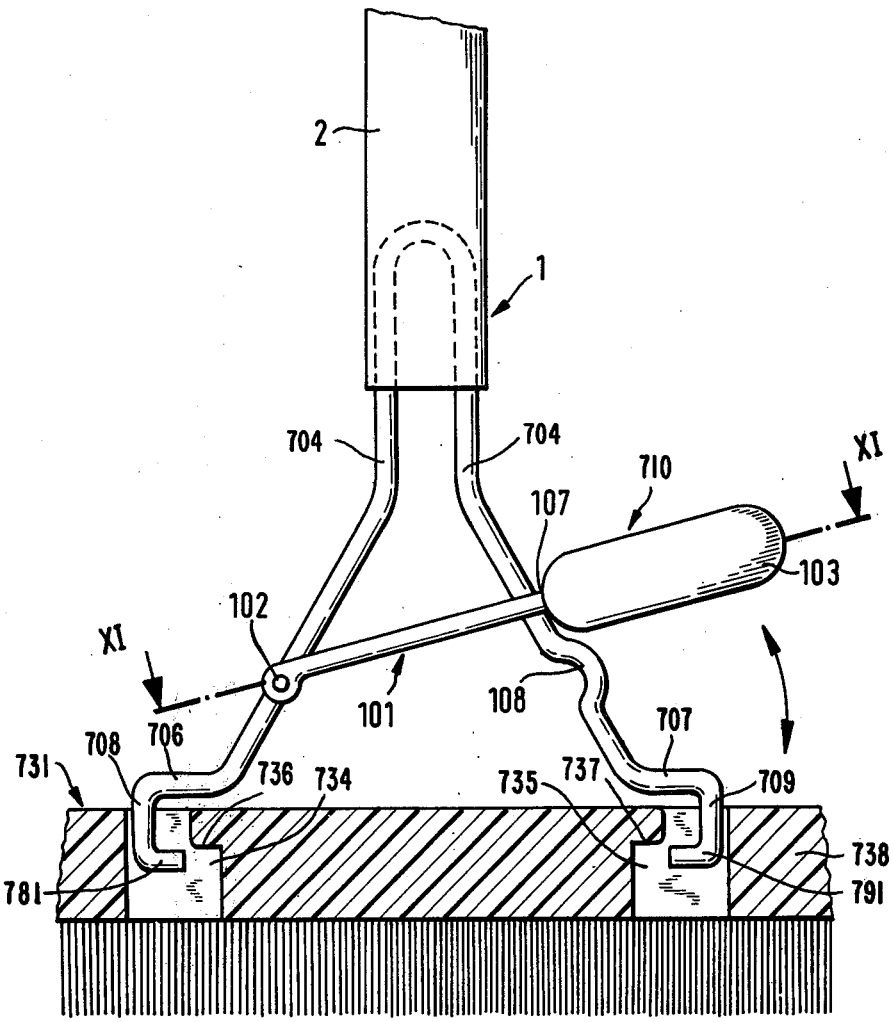
Figure 11:
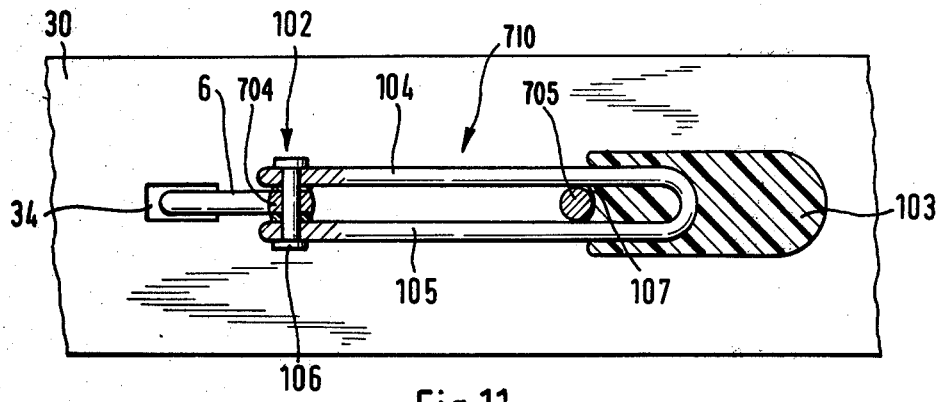
Figure 12:
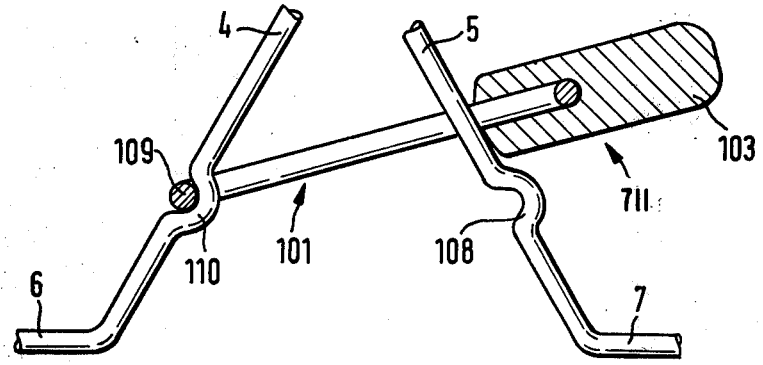
Figure 13:
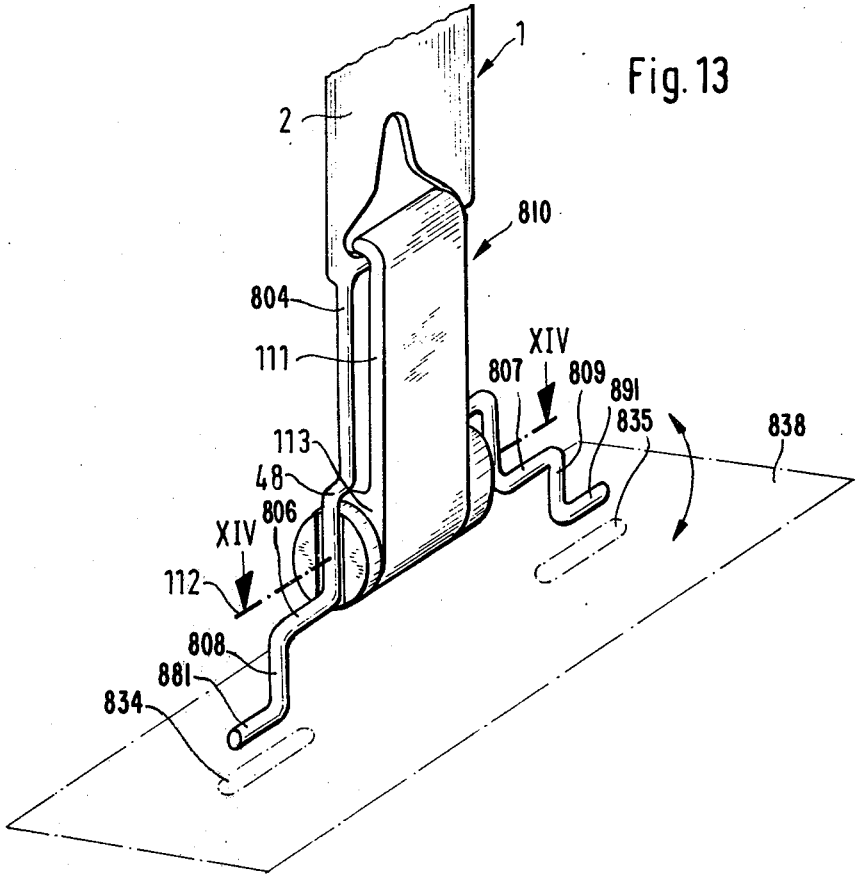
Figure 14:
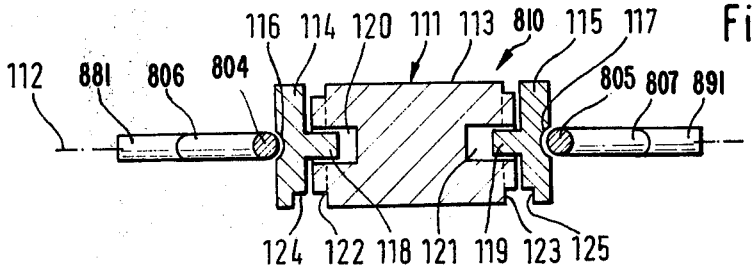
Figure 15:
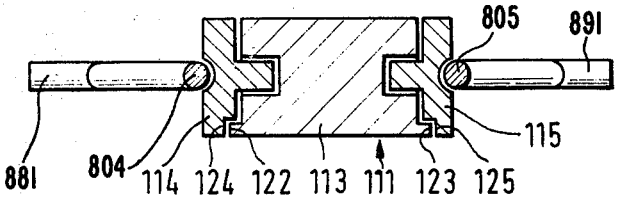
Figure 18:
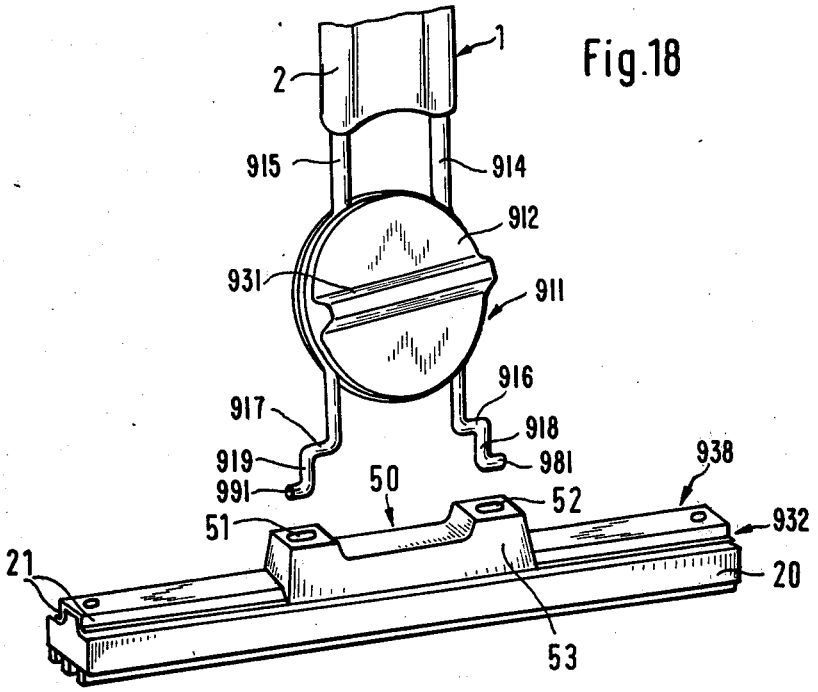
Figure 19:
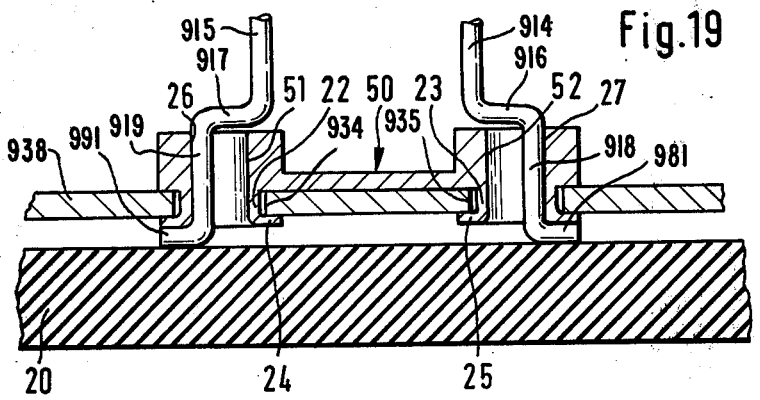

FIG. 2*a* shows the disk of FIG. 2 in outline with the bed of the groove therein in dashed lines;

FIG. 3 shows another practical form of a disc type clamping device;

FIG. 4 shows a practical form of a clamping device with a slider;

FIG. 4*a* is a detail view in section of the practical form according to FIG. 4;

FIG. 5 is a further practical form of a clamping device with a slider;

FIG. 5*a* is a sectional view taken along line V—V in FIG. 5;

FIG. 6 shows a clamping device with a cam disc and slider;

FIG. 6*a* shows the cam disk and slider of FIG. 6 in outline with the bed of the groove therein in dashed lines;

FIG. 7 is a schematic elevation of a third practical form of a clamping device with a slider;

FIG. 8 is a plan view of a practical form of the body of a cleaning implement which may be used, for example, with the forms of the invention illustrated in FIGS. 4, 4*a* and 5;

FIG. 9 is a schematic elevation of a further detail in the construction of the branch arms;

FIG. 10 is a partial elevation of a pivoted clamping device during the mounting thereof;

FIG. 11 is a section along the line XI—XI of FIG. 10;

FIG. 12 is a partially sectioned front elevation of a practical form which is modified as compared with FIGS. 10 and 11;

FIG. 13 is a perspective view of another practical form;

FIG. 14 is a section along the line XIV—XIV of FIG. 13 in the mounted position;

FIG. 15 is a section according to FIG. 14 in the open position;

FIG. 16 shows a further variant of a disc-type clamping device in front elevation;

FIG. 17 is a partially sectioned side elevation of the variant according to FIG. 16;

FIG. 18 is a perspective view of a squeegee before being fitted to the handle;

FIG. 19 is an enlarged section in the direction of the longitudinal axis of the squeegee.

Figure 1:
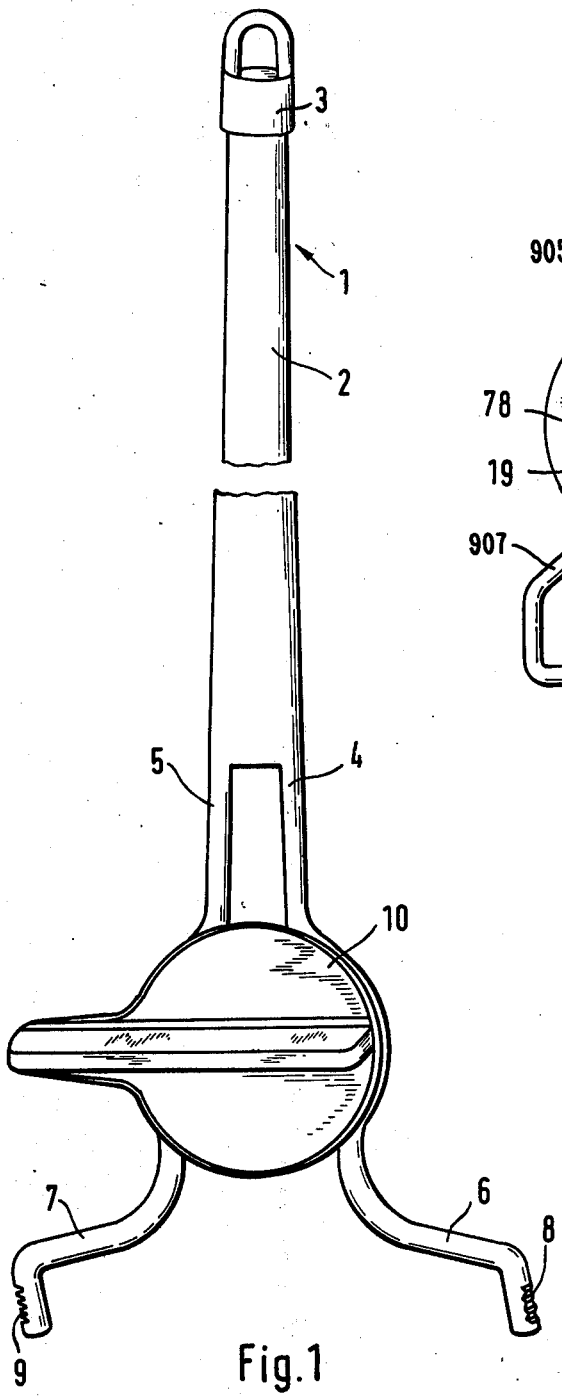
FIG. 1 is an elevation of a handle with a disc clamping device.

The handle 1 illustrated in FIG. 1 comprises a body 2 of tubular or rod cross section, at one end of which there is attached, for example, a suspension strap 3. At the other end the handle 2 is provided with two parallel branched arms 4,5 forming a fork, which in this practical example have outwardly bent limbs 6, 7, which again have vertically bent ends 8,9 provided with a profile to increase the frictional effect. Between the branch arms 4,5 there is fitted a clamping device 10. The clamping device 10 is provided with a manual operating member 30 (FIG. 2).

In assembling the handle 1 to the cleaning implement, which is shown in FIG. 2 in the form of a broom, the upset ends 8,9 of the branch arms are inserted in holes 32,33 provided in the body 38 of the cleaning-implements 31. Then by means of the manual operating member 30 the clamping device 10 is adjusted whereby the branch arms 4, 5 with their limbs 6,7 and the upset ends 8, 9 are spread outwardly and thereby positively secured in the bores 32,33 of the brush body 38.

In the practical form according to FIGS. 1 and 2 the clamping device 10 is designed in the form of a disc 11 provided with a peripheral groove 43. In this groove there are situated the branch arms 4, 5 with the bent limbs 41 in such a manner that the part of the disc 11 which is grooved at 43 is embraced by the bent limbs 41. The bed of the groove 43 is shaped after the manner of a cam disc so that the branch arms 4, 5 assume their closest initial position or are outwardly spread according to the position taken up by the disc 11. Preferably the bed of the groove is provided with two parallel flattened surfaces 961, 962 as shown in FIG. 2*a* for locking the disc 11 in the operative position to the branch arms 4, 5.

In the construction according to FIG. 3 the branch arms 204, 205 are firstly extended parallel to each other, then bent outwardly and then extended parallel in the form of the limbs 61, 71. These limbs 61, 71 are outwardly upset at their ends 81, 91. The cleaning-implement 31 is provided in this case with holes 34, 35 in its body 38, which are provided with undercuts 36, 37. The clamping device 210 is again in this case in the form of a cam disc, but the disc is retained in its position merely by means of the limbs 61, 71 of the bent branch arms 204, 205 on the one hand, and on the other hand by the surface of the body 238. By operating the manual member 230 the limbs 61, 71 are spread apart so that the upset ends 81, 91 engage positively underneath the undercut portions 36, 37 of the holes 34, 35.

In FIG. 4 a practical form is described similar to that in FIG. 3, but in this case the clamping device 310 consists of a slider 12, which is arranged between the two branch arms 304, 305, and which again is provided with a peripheral groove 42 for the substantially parallel limbs 62, 72 of the bent branch arms 304, 305. These limbs are again outwardly upset at their ends 82, 92. By operating the slider 12 in the downward direction of the arrow 13, the parallel limbs 62, 72 of the branch arms 304, 305 are spread apart so that the upset ends 82, 92 become effective in a similar manner to those of the practical example according to FIG. 3. For this purpose the bed of the groove 42 is shaped in the manner visible in FIG. 4*a*. In the narrowed region of the branch arms the slider is provided with a tongue member 44, which forces the upset ends outwardly. In the assembled condition the curved portions 46, 47 engage in the depressions 45 of the slider.

FIG. 5 shows a practical form wherein the clamping device 410 is again in the form of a slider 14 with a manual operating member 430. In this case, however, the branch arms 404, 405 are not curved. Instead, the slider may, for example, embrace the branch arms 404, 405. In the disassembled position the branch arms 404, 405 are inclined to each other as is indicated by the dashed lines. The opposite surfaces of the slider 14 acting upon the branch arms 404, 405 may, however, also converge in the direction of the cylindrical handle 1, so that by pushing down the slider the branch arms 4,5 have their upset ends 83, 93 spread apart. In this practical form, as is also to be assumed in all the other practical forms, locking means are provided for the slider in the assembled position, for which purpose it is possible to use simple projections or locking slots upon the branch arms to fulfill this function.

In the practical form according to FIG. 6 there is again provided a clamping device 510 in the form of a cam disc 15, but the cam portion of this disc operates upon a slider 17, which is arranged between the curved limbs 63, 73 of the branch arms 504,505 and is displaceable in a direction towards the body of the cleaning-implement, which is not shown in the drawing. By means of this slider 17 the upset ends 84, 94 of the arms are spread apart because the shoulders 64, 74 of the slider bear against the curved portions 65, 75 and force these apart. The return of the slider for disengaging and releasing the branch arms can be effected by pushing the slider upwardly with the fingers after turning back the clamping disc 15, the return of the slider 17 being assisted by the natural spring of the branch arms.

In FIG. 7 the practical form is represented in which the branch arms 604, 605 have limbs 66, 76 which are bent crosswise, so that again the upset ends 67,77 can engage in undercut holes in the body of the cleaning-implement. Between the branch arms 604,605 above the crossing point 80 there is again arranged a clamping device 610 in the form of a cam disc 18. Due to the crosswise bending of the branch arms 604,605, the limbs 66, 76 are drawn together when the cam disc 18 is rotated, so that upon operating the clamping device 610 the upset ends 67, 77 penetrate into the undercut holes in the implement body 638.

In FIG. 8 there is shown a practical example of the formation of the holes 634, 635 in the body 638 of the cleaning-implement 631. These holes have a rectangular cross section, the longitudinal dimension of which extends in the direction of the long axis of the body, and the length of which corresponds approximately to the length of the upset ends, for example 82, 83, or 92, 93 of the branch arms. Near to the surface of the body these holes are narrowed to an angular cross section by a corner projection 39. The branch arms are inserted in the position shown in FIG. 8 and following this are so displaced that the upset ends 82, 92 or 83, 93 engage behind the projections 39. Then the clamping device is operated so that the branch arms spread outwardly and frictionally engage against the outer wall of the shorter transverse slot. Furthermore the branch arms can be provided with projections 39 (FIG. 9), by means of which they bear against the surface of the implement body when in the assembled position and thereby limit the penetration depth into said body.

In the practical form according to FIG. 10 the branch arms 704,705 again include substantially horizontally extending bent portions 706,707, continuing into right-angle bends 708,709 and inwardly directed upset portions 781, 791. The implement body 738 possesses holes 734, 735 which are provided with undercuts 736, 737, the edges thereof being rounded. Between the branch arms 704, 705 there is fitted the clamping device 710, which in this practical form includes a pivoted lever 101, which is hinged at one end at the point 102 and possesses a manual operating member 103 at the other end. The manual operating member 103 serves at the same time as a clamping member.

As may be seen more clearly in FIG. 11, the pivoted lever 101 comprises two parallel limbs 104, 105 of a U shaped wire loop, which in the region of its bridge piece is provided with the operating member 103 formed by injection moulded synthetic plastics material. The limbs 104, 105 are pivoted to the branch arm 704 by means of a transverse pin 106 penetrating said arm. The branch arm 704 may for this purpose be flattened at the required point.

In FIG. 10 one position of the branch arms 704,705 is shown immediately before the assembly. The upset ends 81, 91 of the bent portions 708, 709 of the branch arms 704,705 have been introduced into the holes 734, 735 of the implement body 738. Subsequently, the pivoted lever 101 is swung downwardly by means of the manual operating member 103. Thereby the inner edge 107 of the manual operating member 103 slides over the outer surface of the branch arm 705 until it snaps over a projecting nose piece 108 of the branch arm 705 (see FIG. 10). At this point the pivoted lever 103 is in the locked position. In this clamped position the inwardly upset ends 81, 91 of the branch arms 704,705 have engaged behind the undercuts 736, 737 in the holes 734, 735 of the implement body 738. At the same time the downwardly directed bent portions 708,709 of the branch arms 704, 705 are resiliently forced against the upper inner side of the holes 734, 735. The handle 1 is thus securely assembled to the implement body 738.

In the modified practical form according to FIG. 12, the pivoted lever may again consist of two limbs as may be seen in FIG. 11. However these limbs are connected together to form a U loop at the point of pivoting, the bridge piece 109 forming the pivoting axis. This bridge piece 109 engages in a substantially semicircular bent portion 110 of the branch arm 704. In other respects the clamping device 711 possesses the same components as in the practical form shown in FIGS. 10 and 11. Moreover its function is the same.

In the practical form according to FIGS. 13 to 15 the clamping device 810 again includes a pivoted lever 111, but in this case the lever is pivotable in a plane situated normal to the plane of the branch arms 804,805, and it is mounted in a pivot axis 112 extending between the branch arms 804,805. For this purpose the pivoted lever 111 has a cylindrical bearing member 113, which is arranged between the branch arms 804,805. Between the end faces of the cylindrical bearing member 113 and the branch arms 804,805 there is arranged in each case a pressure disc 114,115, each of which is provided at its outer end side with a diametrally directed slot 116, 117, which engages a part of the respective branch arm 804,805. The pressure discs 114, 115 are provided with stud 118, 119, which engage in bores 120, 121 of the cylindrical bearing member 113. In combination with the bores 120, 121 these studs 118, 119 constitute the pivoting axis of the pivoted lever 111. The pressure discs 114, 115 and the cylindrical bearing member 113 of the pivoted lever 111 are held together by the spring force exerted by the branch arms 804,805.

In order to avoid any upward sliding displacement of the cylindrical bearing member 113, the branch arms 804,805 are provided with bent portions 48 (FIG. 13) positioned immediately above the cylindrical bearing member. Any downward slipping of the bearing member is prevented by the fact that the bent out portions 806,807 of the branch arms 804,805 are so arranged that the cylindrical bearing member 113 is situated in a position only slightly above the back surface of the implement body 838. In place of this arrangement it is also possible to provide the branch arms with an inwardly directed bent portion below the bearing member so that the clamping device is fixed between the branch arms when the device is in the non-assembled condition.

In the practical example here shown, the cylindrical bearing member 113 is provided at its end faces with projections 122, 123, for example of arcuate shape, whilst the pressure discs 114, 115 are provided with corresponding incisions 124, 125 at their end faces facing the cylindrical bearing member 113.

In the opened position of the clamping device, the projections 122, 123 engage the incisions 124, 125 under the spring force exerted by the branch arms 804,805, so that the pressure discs 114, 115 have the minimum spacing (FIG. 15). Whilst in this position the upset ends 881, 891 (FIG. 13) of the branch arms 804,805 are introduced into the holes 834, 835 of the body 838 of the implement. At this time the pivoting lever 111 has been swung out forwardly as compared with FIG. 13. By swinging up the pivoted lever 111 into the position shown in FIG. 13, the pressure discs 114, 115 are forced outwardly, whereby the projections 122, 123 upon the cylindrical bearing member 113 disengage from the incisions 124, 125 and support themselves against the end faces of the pressure discs 114, 115 facing the bearing member. At the same time the studs 118, 119 of the pressure discs are displaced to some extent outwardly from the bores 120, 121. At the same time the branch arms 804, 805 are forced outwardly so that the upset ends 881, 891 again engage behind suitably shaped undercuts in the body of the implement, whilst the downwardly directed bent portions 808, 809 of the branch arms are resiliently clamped against the interior wall at the outer end of the holes 834, 835. In order to facilitate the swinging of the pivoted lever 111, it is possible to arrange inclined surfaces, not shown in the drawing, between the incisions 124, 125 and the end surfaces of the pressure discs 114, 115, as well as between the projections 122, 123 and the end faces of the bearing member 113.

Similarly a further locking action can be arranged to be effective, if desired, when the parts are in the clamping position shown in FIG. 14. Moreover it is possible to provide further projections and incisions arranged diametrally opposite those already described. The practical form according to FIG. 13 can obviously also be modified in such a manner that the pressure discs lie at the outer side of the branch arms, and the pivoting lever engages these at their outer side so that the branch arms are not forced outwardly but are drawn inwardly to effect the clamping. The upset ends 881, 891 are then correspondingly directed inwardly.

The spacing between the free upset ends of the branch arms can be so selected in dependence upon the spacing between the inner (FIG. 10) and the outer wall (FIG. 13) of the holes, in the implement body that firstly one of these ends is introduced into a hole, whereafter the other end is inserted, so that even when the device is in the unclamped position there is an anchorage of the ends of the branch arms in the holes and the assembly of the device is simplified. Moreover the stability of the connection in the assembled position is improved.

In all the above described practical forms the resistance to distortion of both of the branch arms is improved by reason of the fact that both of the branch arms are embraced at both sides by the clamping device—in the one case by the limbs 104, 105 in FIGS. 10 to 12, and in the other case by the grooves 116, 117 of the pressure discs 114, 115 in FIGS. 13 to 15. Moreover all of the practical forms are successfully designed with simple push connections between the clamping device and the branch arms and between the latter and the body of the implement. In particular no screw connections or the like are necessary.

In the practical form according to FIGS. 16 and 17 the branch arms 904,905 are again provided with bent out portions 906,907 and with inner upset ends 69, 79. Furthermore the device includes a clamping device 910 in the form of a disc 16 having a manual operating member 930 and provided with a guide 19 in the form of a slot. This slot guide comprises two mutually opposite substantially parallel sections which merge into each other by means of rounded curves, that is to say form a closed curve. A respective stud 68, 78 is arranged to engage in opposite sections of the slot guide 19, the studs being secured to the branch arms 904, 905, for example by spot welding. The studs penetrate the slot guide 19 to the front side of the disc 16 (FIG. 17), where they are each swaged over to form a head. In place of this arrangement it is obviously possible to provide the studs with threads and to fit a nut. Furthermore it is possible to mount upon the disc 16 (without the manual member 930) a further disc itself having a manual member, in order to mask the slot guide 19 and the studs 67, 78.

If the disc is rotated through 90° out of the position shown in FIG. 16, then the branch arms 904,905 are drawn together because the studs 68, 78 progress into that section of the slot guide 19 which provides the smallest spacing distance. The upset ends 69, 79 then engage behind the undercut portions of the holes in the implement body.

Whilst all the above described practical forms are described in combination with a cleaning-implement, whose body comprises wood or, preferably, synthetic plastic material, cleaning-implements are also known, which are provided with a metallic body portion, which is therefore usually of very small wall thickness. Thus in FIG. 18 there is shown a cleaning-implement 932 in the form of a squeegee, comprising a rubber strip 20 and a body 938. The body 938 is a U section channel strip and the rubber strip 20 is secured between the two flanges 21 of the U section rail, for example by clamping. The function of a manual operating member for the cleaning-implement 932 is again served by a handle 1, which comprises a cylindrical stem member 2 and two branch arms 914,915. The branch arms 4,5 proceed at first substantially parallel, are then outwardly bent and finally again proceed parallel to each other but at a greater spacing. The horizontal portions 916,917 are followed again by parallel vertical portions 918, 919, which terminate in the outwardly upset ends 981, 991. As in the previously described practical forms, a clamping device 911 is mounted between the branch arms 914,915, this being in the form of a cam disc 912 which is rotatable by means of a bar shaped grip 931. By rotating the cam disc 912 the branch arms 914,915 can be spread apart in opposition to their spring force.

The cleaning-implement 932 is provided at its central region with a mounting head, which in the described practical example is designed as a separate component. This is provided with two slots 51, 52. Furthermore it has side flanges 53, whereby it engages along the flanges 21 of the U section rail 938.

As is seen more particularly from FIG. 19 the U shaped rail 938 is provided with slots 934, 935, as in the previously described practical forms. The mounting head 50 is provided with downwardly projecting extensions 22, 23, which in the practical example here shown are formed by the downwardly extended walls of the holes 51, 52 in the mounting head. These wall portions are expanded at their lower edges 24, 25 so that they are riveted to the underside of the U section rail. In the assembled position the sections 918, 919 of the branch arms 914,915 engage in the slots 934, 935, whilst the upset ends 81, 91 of the arms engage behind the web of the U section rail 38. Thus the slots 51, 52 form an abutment surface 26, 27 practically along their total axial length for the sections 8, 9 of the branch arms, so that in this way an adequate force fit is achieved, and additionally a positive lock is afforded by the upset ends 981, 991. The anchorage is improved by reason of the fact that the upset ends 981, 991 are resiliently clamped between the rubber strip 20 and the U section rail 38.

In the practical example here shown the branch arms 914,915 are double bent, as shown by the first horizontal section 916,917, and a second horizontal section which is represented by the upset ends 981, 991. The vertical height of the intervening vertical sections 918,919 corresponds to the vertical height of the mounting head 50 including the height dimension remaining after expanding the projections 22, 23. After insertion of the branch arms in the slots, the first horizontal section 916,917 of the branch arms bears upon the upper side of the mounting head 50, whilst the upset ends 981, 991 engage behind the underside of the U section rail. If necessary, it is possible to provide further recesses in that position in which the upset ends will lock. The anchorage will thus be improved not only by reason of the pressure laterally against the side walls of the holes, but also by the clamping effect exerted upon the branch arms at the parts thereof situated between the two horizontal sections.

What is claimed is:

1. A clamping device for releasably securing a body to a handle having an end portion comprising two sprung branch arms in the form of a fork, the arms having bent portions and being securable in apertures of said body by means of the clamping device which is adapted to be positioned between and engage said branch arms and be movable between said branch arms for releasably securing the arms in the apertures of said body, said clamping device comprising peripheral groove means for receiving bent portions of said branch arms, the bends of said arms corresponding to the outline of the groove means in the region of the clamping device, and said device having a manual control member, the base of said groove means constituting a cam means and being provided with at least one flattened portion for locking the clamping device when the branch arms are securely clamped in the apertures of said body.

2. A clamping device according to claim 1, wherein the cam means of said clamping device is a disc which spreads the branch arms outwardly to securely clamp them in the apertures of said body.

3. A device according to claim 1, in combination with said handle end portion, in which the branch arms are upset at the ends thereof which engage in the apertures of said body and, when in the assembled position, these upset portions engage behind undercuts in said apertures.

4. A device according to claim 3, in combination also with said body, in which said apertures are of rectangular shape having a free cross section at the upper side of said body constricted by a rectangular projection constituting said undercut.

5. A handle for a cleaning-implement, the handle having an end portion comprising two sprung branch arms in the form of a fork, the handle being provided with a device according to claim 1 for releasably securing it to a body of a cleaning-implement.

6. A cleaning-implement comprising a body, a handle having an end portion comprising two sprung branch arms in the form of a fork, and a device according to claim 1 for releasably securing the body to the handle.

7. A cleaning implement such as a broom, scrubber or squeegee comprising a body, a handle member and a clamping device releasably securing the body to said handle member, said handle member having an end portion comprising two sprung branch arms in the form of a fork, the arms having bent portions and being, releasably secured in apertures of said body by means of the clamping device which is positioned between and engages said branch arms and is movable between said branch arms for releasably securing the arms in the apertures of said body, said clamping device comprising a manual control member and peripheral groove means receiving bent portions of said branch arms, the bent portion of each branch arm including at least one curved portion, the bends of said arms corresponding to the outline of the groove means in the region of the clamping device so that said clamping device is securely supported in all its positions of movement and so that said clamping device offers resistance to torsional forces arising between the body and handle member.

8. A cleaning implement according to claim 7, wherein the base of said groove means is a cam means.

9. A cleaning implement according to claim 7, wherein the clamping device includes a slider displaceable for spreading apart the branch arms.

10. A cleaning implement according to claim 7, in combination with said handle and portion, in which the branch arms are bent crosswise, the clamping device being arranged between the shanks of the branch arms situated above the crossing point, whilst those shanks of the branch arms situated below the crossing point are arranged to engage in said apertures in the body of the cleaning-implement.

11. A cleaning implement according to claim 6, wherein the slider is provided with said peripheral groove means in which the branch arms lie when the clamping device is fitted thereto.

12. A cleaning implement according to claim 7, wherein said cleaning-implement body comprises a rubber strip and a body in the form of a U shaped rail for holding the strip, wherein the U shaped rail is provided with said apertures for the branch arms and with a member for extending the length of said holes.

13. A cleaning implement according to claim 12, in combination also with said handle end portion in which the ends of the branch arms are outwardly bent and, when in the assembled position, engage behind the back of the U shaped rail.

14. A cleaning implement according to claim 12 wherein said member is a separate injection-moulded component and is secured to the web of the U shaped rail.

15. A cleaning implement according to claim 12, wherein said member is provided with side walls which engage over the flanges of the U shaped rail.

16. A cleaning implement according to claim 12, wherein said member is provided at its lower side with projections, which are inserted into the apertures in the U shaped rail and are riveted thereto.

17. A cleaning implement according to claim 16, wherein the projections upon said member are formed by downwardly extending wall portions surrounding holes in said member, and said wall portions are widened at the underside of the U shaped rail.

18. A cleaning implement according to claim 12 in combination also with said handle end portion in which the branch arms are provided with two successive bends, so that in each case the first horizontal portion of each arm lies at the upper side of said member, whilst the second horizontal section of each arm forms the upset end thereof, and engages the underside of the U shaped rail.

19. A cleaning implement according to claim 18, wherein said second horizontal section engages in a recess provided in the underside of the U shaped rail.

20. A cleaning implement according to claim 8, wherein the cam means of the clamping device is a cam disc, said clamping device further including a slider movable between the branch arms, the cam disc operating upon the slider.

21. A cleaning implement according to claim 8, wherein said cam means is rotatable and said manual control member is operatively connected to said cam means for effecting rotation of said cam means to releasably secure the arms in the apertures of said body.

* * * * *